US008564509B2

(12) United States Patent
Shin et al.

(10) Patent No.: US 8,564,509 B2
(45) Date of Patent: Oct. 22, 2013

(54) DISPLAY DEVICE AND DRIVING METHOD THEREOF

(75) Inventors: Kyoung-Ju Shin, Yongin-si (KR); Cheol-Woo Park, Suwon-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 1237 days.

(21) Appl. No.: 11/623,563

(22) Filed: Jan. 16, 2007

(65) Prior Publication Data

US 2007/0164938 A1 Jul. 19, 2007

(30) Foreign Application Priority Data

Jan. 16, 2006 (KR) ..... 10-2006-0004410

(51) Int. Cl.
*G09G 3/30* (2006.01)
*G09G 3/32* (2006.01)

(52) U.S. Cl.
USPC ..... 345/80; 345/76; 345/82

(58) Field of Classification Search
USPC ..... 345/76–83, 39, 204–215, 690–699; 315/169.1–169.4
See application file for complete search history.

(56) References Cited

U.S. PATENT DOCUMENTS

| | | | | |
|---|---|---|---|---|
| 5,552,678 | A * | 9/1996 | Tang et al. | 315/169.3 |
| 6,548,960 | B2 * | 4/2003 | Inukai | 315/169.3 |
| 6,730,966 | B2 | 5/2004 | Koyama | |
| 6,864,637 | B2 * | 3/2005 | Park et al. | 315/169.1 |
| 6,870,192 | B2 | 3/2005 | Yamazaki et al. | |
| 7,053,875 | B2 * | 5/2006 | Chou | 345/92 |
| 7,397,448 | B2 * | 7/2008 | Stevenson et al. | 345/76 |
| 8,279,243 | B2 * | 10/2012 | Lin et al. | 345/690 |
| 2002/0050962 | A1 * | 5/2002 | Kasai | 345/76 |
| 2002/0195968 | A1 * | 12/2002 | Sanford et al. | 315/169.3 |
| 2003/0160745 | A1 * | 8/2003 | Osame et al. | 345/82 |
| 2003/0184505 | A1 | 10/2003 | Inukai et al. | |
| 2004/0056605 | A1 * | 3/2004 | Yoshida | 315/169.3 |
| 2004/0075627 | A1 * | 4/2004 | Ouchi et al. | 345/76 |
| 2004/0090186 | A1 * | 5/2004 | Yoshida et al. | 315/169.1 |
| 2004/0095299 | A1 | 5/2004 | Matsumoto | |
| 2004/0227709 | A1 * | 11/2004 | Lih et al. | 345/82 |
| 2004/0233143 | A1 * | 11/2004 | Kasai | 345/76 |
| 2005/0242746 | A1 * | 11/2005 | Miyagawa et al. | 315/169.3 |
| 2006/0145968 | A1 * | 7/2006 | You et al. | 345/76 |
| 2007/0091035 | A1 * | 4/2007 | Osame et al. | 345/76 |
| 2009/0096725 | A1 * | 4/2009 | Kretz et al. | 345/82 |
| 2011/0216056 | A1 * | 9/2011 | Yoo et al. | 345/212 |

FOREIGN PATENT DOCUMENTS

| | | |
|---|---|---|
| JP | 2003195808 | 7/2003 |
| JP | 2004117921 | 4/2004 |
| JP | 2005050797 | 2/2005 |
| JP | 2005140827 | 6/2005 |
| JP | 2005164894 | 6/2005 |
| JP | 2005195756 | 7/2005 |
| JP | 2005195777 | 7/2005 |

(Continued)

*Primary Examiner* — Alexander Eisen
*Assistant Examiner* — Patrick F Marinelli
(74) *Attorney, Agent, or Firm* — Cantor Colburn LLP

(57) ABSTRACT

A display device includes a light emitting element, a first driving transistor coupled to the light emitting element and supplied with a first driving voltage, and a second driving transistor coupled to the light emitting element and the first driving transistor and supplied with a second driving voltage having a magnitude different from the first driving voltage at least for a time. A method of driving the display device is also provided.

32 Claims, 10 Drawing Sheets

(56) References Cited

FOREIGN PATENT DOCUMENTS

| | | |
|---|---|---|
| KR | 1020010018261 | 3/2001 |
| KR | 1020040020799 | 3/2004 |
| KR | 1020040025816 | 3/2004 |
| KR | 1020050031951 | 4/2005 |
| KR | 1020050095149 | 9/2005 |
| KR | 1020050110823 | 11/2005 |

* cited by examiner

DISPLAY DEVICE AND DRIVING METHOD THEREOF

This Application claims priority to Korean patent application number 10-2006-0004410, filed on Jan. 16, 2006 and all the benefits accruing therefrom under 35 U.S.C. §119, and the contents of which in its entirety are herein incorporated by reference.

BACKGROUND OF THE INVENTION (a) Field of the Invention

The present invention relates to a display device and a driving method thereof. More particularly, the present invention relates to a display device having a reduced degradation of its driving transistors, and a driving method thereof.

(b) Description of Related Art

Recently, flat panel displays have been actively studied as substitutes for conventional cathode ray tubes ("CRT"). In particular, organic light emitting diode ("OLED") displays are focused on as next-generation flat panel displays because of their good luminance characteristics and viewing angle characteristics.

Generally, an active matrix flat panel display includes a plurality of pixels arranged in a matrix and displays images by controlling the luminance of the pixels based on given luminance information. An OLED display is a self-emissive display device that displays images by electrically exciting light emitting organic material. An OLED display has low power consumption, wide viewing angle, and fast response time, thereby being advantageous for displaying motion images.

A pixel of an OLED display includes an OLED and a driving thin film transistor ("TFT"). The TFT includes polysilicon or amorphous silicon. A polysilicon TFT has several advantages, but it also has disadvantages such as the complexity of manufacturing polysilicon thin films, thereby increasing the manufacturing cost. In addition, it is difficult to make a large OLED display employing polysilicon TFTs.

On the contrary, an amorphous silicon TFT is easily applicable to a large OLED display and can be manufactured by a lesser number of process steps than the polysilicon TFT.

However, the threshold voltage of the amorphous silicon TFT shifts as time goes by due to a long-time application of a unidirectional voltage to a gate of the TFT such that the current flowing in the OLED under a given voltage is non-uniform thus degrading image quality and shortening the lifetime of the OLED.

Accordingly, a reverse bias voltage is suggested to be applied to the driving transistor for compensating the shift of the threshold voltage. However, the application of the reverse bias voltage may be insufficient for reducing the degradation of characteristics of the driving transistor such as the threshold voltage shift.

BRIEF SUMMARY OF THE INVENTION

An exemplary display device according to an exemplary embodiment of the present invention includes a light emitting element; a first driving transistor coupled to the light emitting element and supplied with a first driving voltage, and a second driving transistor coupled to the light emitting element and the first driving transistor and supplied with a second driving voltage having a magnitude different from the first driving voltage at least for a time.

The first driving voltage and the second driving voltage may be periodical signals having time-varying magnitudes.

The first driving voltage and the second driving voltage may have a reference value during a first time period and may have different values during a second time period. That is, the first driving voltage may have a first value during the second time period different from the reference value and different from a second value of the second driving voltage during the second time period. In particular, the first driving voltage and the second driving voltage may have opposite values with respect to the reference value during the second time period.

The first time period and the second time period may alternate, and each of the first driving voltage and the second driving voltage may maintain a uniform value or may vary in an opposite manner with respect to the reference value during the second time period. When varying in an opposite manner, the first driving voltage may include a lower value and a higher value than the reference value during the second time period, and the second driving voltage may include a higher value and a lower value than the reference value during the second time period.

The light emitting element may stop light emission during the second time period, and at this time, the light emitting element may be supplied with a common voltage having different values between the first time period and the second time period, where the common voltage may be increased during the second time period.

The first time period may include a third time period and a fourth time period, and the light emitting element emits light in the third time period and stops light emission in the fourth time period. The first and second driving transistors may be supplied with a reverse bias voltage during the fourth time period to turn off the first and second driving transistors during the fourth time period.

The first driving transistor may have a control terminal, an input terminal supplied with the first driving voltage, and an output terminal coupled to the light emitting element, the second driving transistor may have a control terminal, an input terminal supplied with the second driving voltage, and an output terminal coupled to the light emitting element, and the control terminals of the first and the second driving transistors may be supplied with a data voltage during the first time period and may be floating during the second time period.

The first and second driving transistors may be supplied with a reverse bias voltage to turn off the first and second driving transistors for a portion of the first time period.

The display device may further include a first switching transistor coupled to the first driving transistor and applying a data voltage to a control terminal of the first driving transistor according to a scanning signal, and a second switching transistor coupled to the second driving transistor and applying a data voltage to a control terminal of the second driving transistor according to the scanning signal. A control terminal of the first switching transistor and a control terminal of the second switching transistor may be connected to a same scanning line.

The display device may further include a switching transistor coupled to the first and the second driving transistors and applying a data voltage to control terminals of the first and the second driving transistors according to a scanning signal.

The display device may further include a first capacitor connected between a control terminal and an input terminal of the first driving transistor, and a second capacitor connected between a control terminal and an input terminal of the second driving transistor.

The light emitting element may emit light when the first driving voltage and the second driving voltage have different values.

The display device may further include a plurality of pixels, where each pixel includes one of the first driving transistor and one of the second driving transistor. Also, the display device may further include a voltage generator supplying the first driving voltage, the second driving voltage, and a common voltage to the first driving transistor, the second driving transistor, and the light emitting element, respectively.

An exemplary display device according to another exemplary embodiment of the present invention includes a light emitting element, and at least one driving transistor supplying a current to the light emitting element, wherein a current flowing in the at least one driving transistor changes at least for a time.

A direction of the current flowing in the at least one driving transistor may be opposite between a first time period and a second time period shorter than the first time period, and the light emitting element may stop light emission in the second time period.

An exemplary display device according to another exemplary embodiment of the present invention includes a light emitting element, a first driving transistor supplying a current to the light emitting element, and a second driving transistor supplying a current to the light emitting element, wherein a current flowing in the first driving transistor points opposite a current flowing in the second driving transistor at least for a time.

The current flowing in the first driving transistor may point in a same direction as the current flowing in the second driving transistor during a light emission display period of the light emitting element, and the current flowing in the first driving transistor may point opposite the current flowing in the second driving transistor during a refresh period preventing degradation of the first and second driving transistors.

An exemplary method of driving an exemplary display device according to an exemplary embodiment of the present invention includes applying a data voltage to control terminals of the first and the second driving transistors having output terminals coupled to a light emitting element, applying a first driving voltage to an input terminal of the first driving transistor, applying a second driving voltage to an input terminal of the second driving transistor the second driving voltage, and differentiating values of the first driving voltage and the second driving voltage.

Differentiating values of the first driving voltage and the second driving voltage may include providing opposite values with respect to a reference value during a refresh period and preventing degradation of the first and second driving transistors.

The method may further include equalizing values of the first driving voltage and the second driving voltage, wherein differentiating values of the first driving voltage and the second driving voltage and equalizing values of the first driving voltage and the second driving voltage are alternately performed.

Equalizing the first driving voltage and the second driving voltage may include emitting the light emitting element. In addition, the differentiating the first driving voltage and the second driving voltage may include stopping emission of the light emitting element.

Stopping emission of the light emitting element may include changing a value of a common voltage applied to the light emitting element.

Equalizing the first driving voltage and the second driving voltage may include emitting the light emitting element, and stopping emission of the light emitting element.

Stopping emission of the light emitting element may include applying a negative bias voltage to the control terminals of the first and the second driving transistors.

BRIEF DESCRIPTION OF THE DRAWINGS

The present invention will become more apparent by describing exemplary embodiments thereof with reference to the accompanying drawing in which.

DETAILED DESCRIPTION OF THE INVENTION

Figure 1:
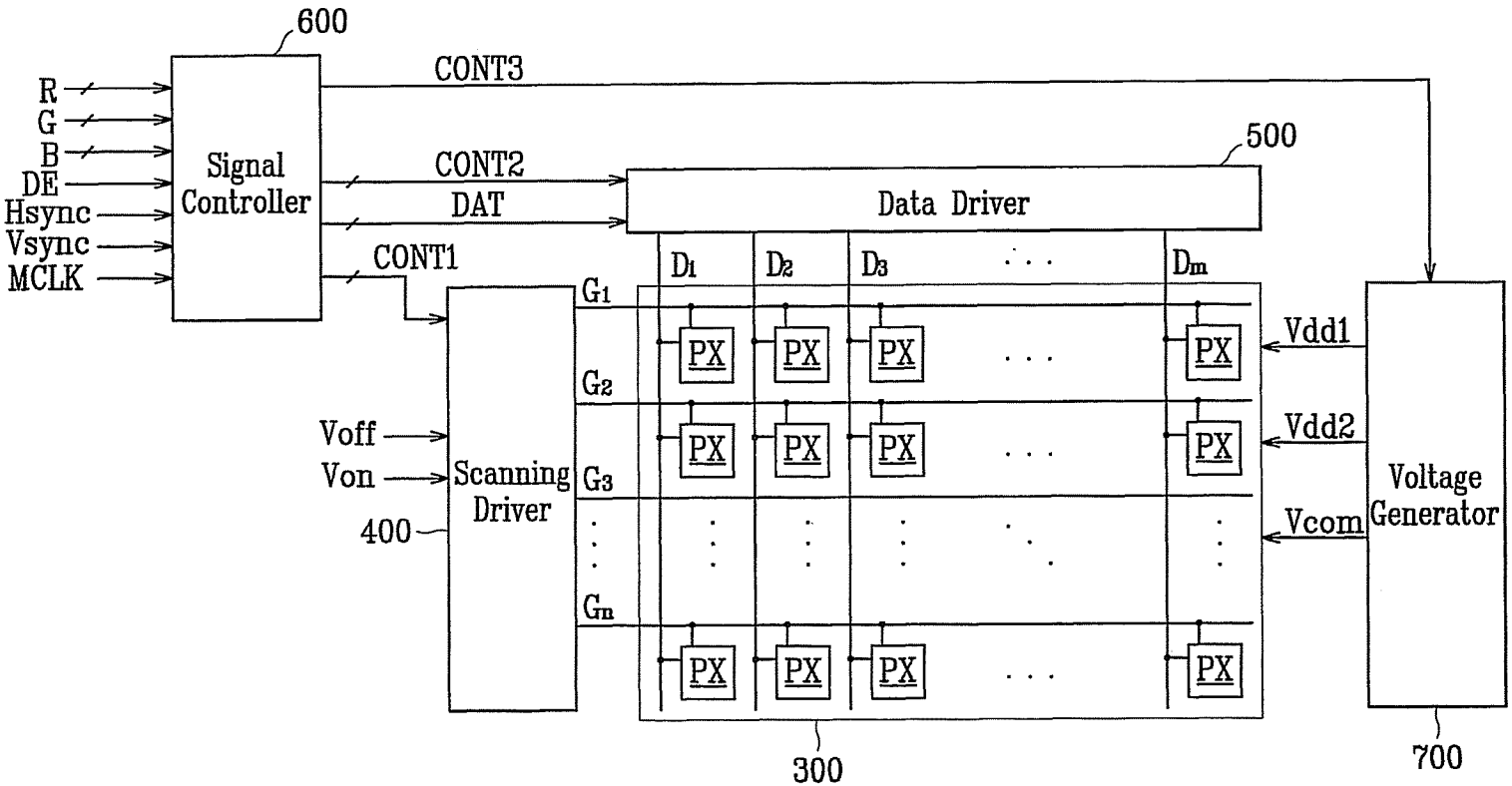
FIG. 1 is a block diagram of an exemplary OLED display according to an exemplary embodiment of the present invention.

The present invention now will be described more fully hereinafter with reference to the accompanying drawings, in which preferred embodiments of the invention are shown. In the drawings, the thickness of layers and regions are exaggerated for clarity. Like numerals refer to like elements throughout.

It will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Figure 2:
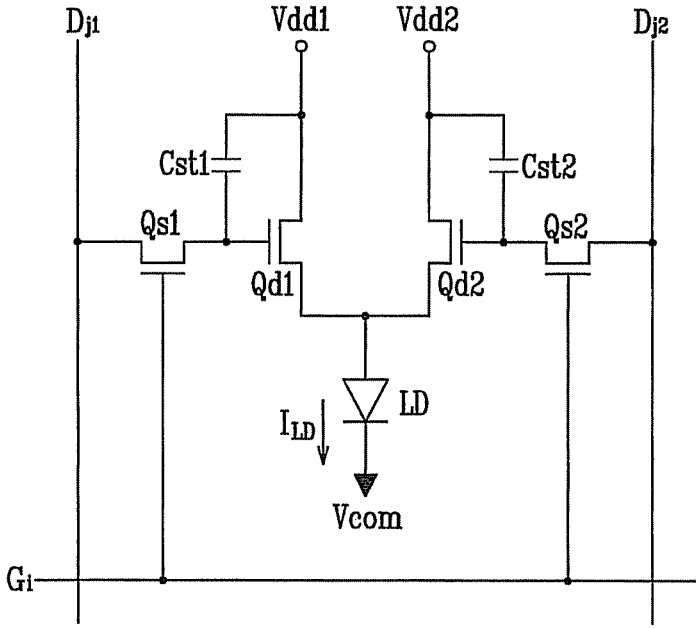
FIG. 2 is an equivalent circuit diagram of an exemplary pixel of an exemplary OLED display according to an exemplary embodiment of the present invention.

Referring to FIGS. 1 and 2, an exemplary organic light emitting diode ("OLED") display according to an exemplary embodiment of the present invention will be further described.

FIG. 1 is a block diagram of an exemplary OLED display according to an exemplary embodiment of the present invention and FIG. 2 is an equivalent circuit diagram of an exemplary pixel of an exemplary OLED display according to an exemplary embodiment of the present invention.

Referring to FIG. 1, an OLED display includes a display panel 300, a scanning driver 400, a data driver 500, and a voltage generator 700 that are connected to the display panel 300, and a signal controller 600 controlling the above elements.

The display panel 300 includes a plurality of signal lines $G_1$-$G_n$ and $D_1$-$D_m$, a plurality of voltage lines (not shown), and a plurality of pixels PX connected thereto and arranged substantially in a matrix.

The signal lines include a plurality of scanning lines $G_1$-$G_n$, also referred to as gate lines, transmitting scanning signals from scanning driver 400 and a plurality of data lines $D_1$-$D_m$, also referred to as source lines, transmitting data voltages from data driver 500. The scanning lines $G_1$-$G_n$ extend substantially in a row direction and substantially parallel to each other, while the data lines $D_1$-$D_m$ extend substantially in a column direction and substantially parallel to each other. Referring to FIG. 2, each of the data lines $D_1$-$D_m$, for example, the j-th data line $D_j$ (j=1, 2, . . . , m) is bifurcated into two branch lines $D_{j1}$ and $D_{j2}$.

Each of the voltage lines transmits first and second driving voltages Vdd1 and Vdd2, etc.

Referring to FIG. 2, each pixel PX, for example, a pixel connected to a scanning line $G_i$ (i=1, 2, . . . , n) and a data line $D_j$ includes an OLED (diode) LD, first and second driving transistors Qd1 and Qd2, first and second capacitors Cst1 and Cst2, and first and second switching transistors Qs1 and Qs2.

The first/second switching transistor Qs1/Qs2 has a control terminal (gate electrode), an input terminal (source electrode), and an output terminal (drain electrode). The control terminal of the first/second switching transistor Qs1/Qs2 is connected to the scanning line $G_i$, and the input terminal of the first/second switching transistor Qs1/Qs2 is connected to the first/second branch line $D_{j1}$/$D_{j2}$ of the data line $D_j$. The output terminal of the first/second switching transistor Qs1/Qs2 is connected to a control terminal of the first/second driving transistor Qd1/Qd2. The first/second switching transistor Qs1/Qs2 transmits the data voltage in response to the scanning signal applied to the scanning line $G_i$.

The first/second driving transistor Qd1/Qd2 also has a control terminal (gate electrode), as well as an input terminal (source electrode) and an output terminal (drain electrode). The control terminal of the first/second driving transistor Qd1/Qd2 is connected to the output terminal of the first/second switching transistor Qs1/Qs2, and the input terminal of the first/second driving transistor Qd1/Qd2 is connected to the first/second driving voltage Vdd1/Vdd2. The output terminal of the first/second driving transistor Qd1/Qd2 is connected to the OLED LD. The first and the second driving transistors Qd1 and Qd2 make output currents having magnitudes depending on the voltage differences between the control terminals and the output terminals thereof, and the sum of the output currents of the two driving transistors Qd1 and Qd2 forms a driving current $I_{LD}$ flowing in the OLED LD.

The first/second capacitor Cst1/Cst2 is connected between the control terminal and the input terminal of the first/second driving transistor Qd1/Qd2. The first/second capacitor Cst1/Cst2 stores the data voltage applied to the control terminal of the first/second driving transistor Qd1/Qd2 and maintains the stored voltage after the first/second switching transistor Qs1/Qs2 turns off.

The OLED LD has an anode connected to the output terminal of the first/second driving transistor Qd1/Qd2 and a cathode connected to a common voltage Vcom. The OLED LD emits light having an intensity depending on the driving current $I_{LD}$.

The switching transistors Qs1 and Qs2 and the driving transistors Qd1 and Qd2 may be n-channel field effect transistors ("FETs") including amorphous silicon or polysilicon. However, alternatively, at least one of the transistors Qs1, Qs2, Qd1 and Qd2 may be p-channel FETs. While a particular equivalent circuit diagram of a pixel is shown in FIG. 2, the connection relationship among the transistors Qs1, Qs2, Qd1 and Qd2, the capacitors Cst1 and Cst2, and the OLED LD may be interchanged.

Referring to FIG. 1 again, the scanning driver 400 is connected to the scanning lines $G_1$-$G_n$ of the display panel 300 and synthesizes a high voltage Von for turning on the switching transistors Qs1 and Qs2 and a low voltage Voff for turning off the switching transistors Qs1 and Qs2 to generate scanning signals for application to the scanning lines $G_1$-$G_n$.

The data driver 500 is connected to the data lines $D_1$-$D_m$ of the display panel 300 and applies data voltages corresponding to image signals to the data lines $D_1$-$D_m$.

The voltage generator 700 generates the first and the second driving voltages Vdd1 and Vdd2 and the common voltage Vcom and outputs the voltages Vdd1, Vdd2, and Vcom to the display panel 300 according to a voltage control signal CONT3 from the signal controller 600.

The signal controller 600 controls the scanning driver 400, the data driver 500, and the voltage generator 700.

The driving units 400, 500, 600, 700 may be implemented as integrated circuit ("IC") chips mounted on the display panel 300 or on flexible printed circuit ("FPC") films in a tape carrier package ("TCP") type, which are attached to the display panel 300. Alternately, they may be integrated into the display panel 300 along with the signal lines $G_1$-$G_n$ and $D_1$-$D_m$ and the transistors Qd1, Qd2, Qs1 and Qs2, where the transistors Qd1, Qd2, Qs1 and Qs2 may be thin film transistors ("TFTs"). The driving units 400, 500, 600 and 700 may be integrated into a single chip, but, alternatively, at least one of the driving units 400, 500, 600 and 700 or at least one circuit element of the driving units 400, 500, 600 may be separately provided apart from the single chip.

Now, an operation of the exemplary OLED display is further described with reference to FIGS. 3 through 7.

Figure 3:
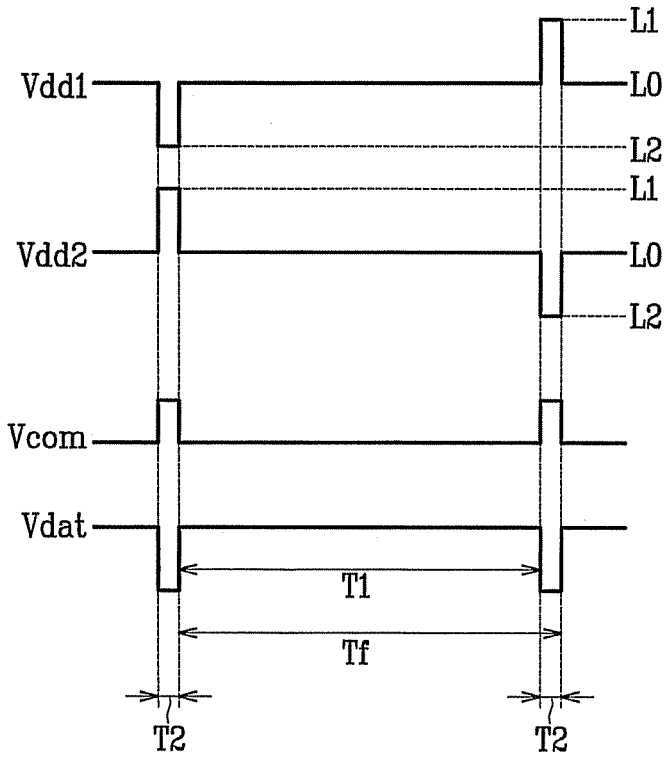
FIG. 3 shows waveforms of various signals in an exemplary OLED display according to an exemplary embodiment of the present invention.
Figure 4:
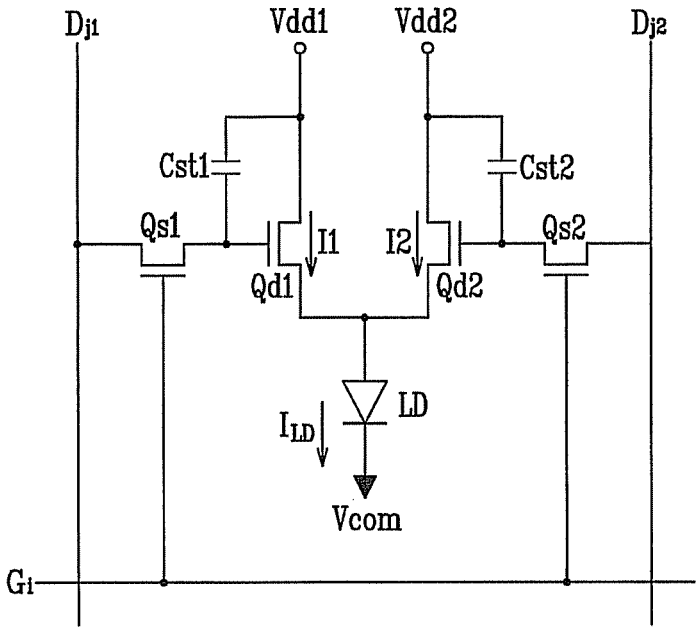
FIGS. 4, 5, and 6 schematically show currents in exemplary first and second driving transistors.
Figure 5:
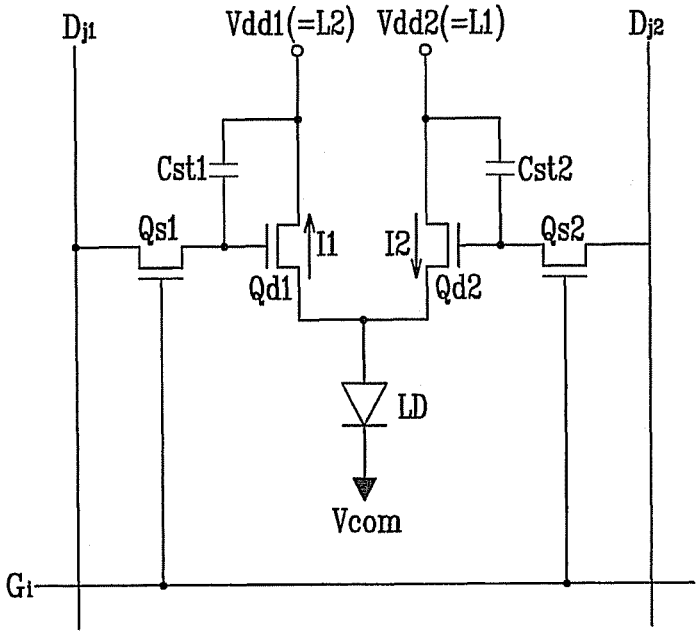
Figure 6:
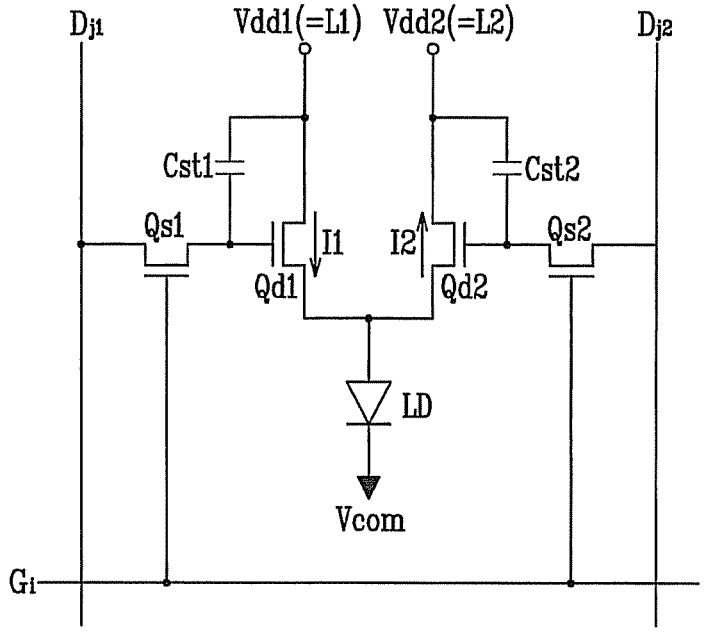
Figure 7:
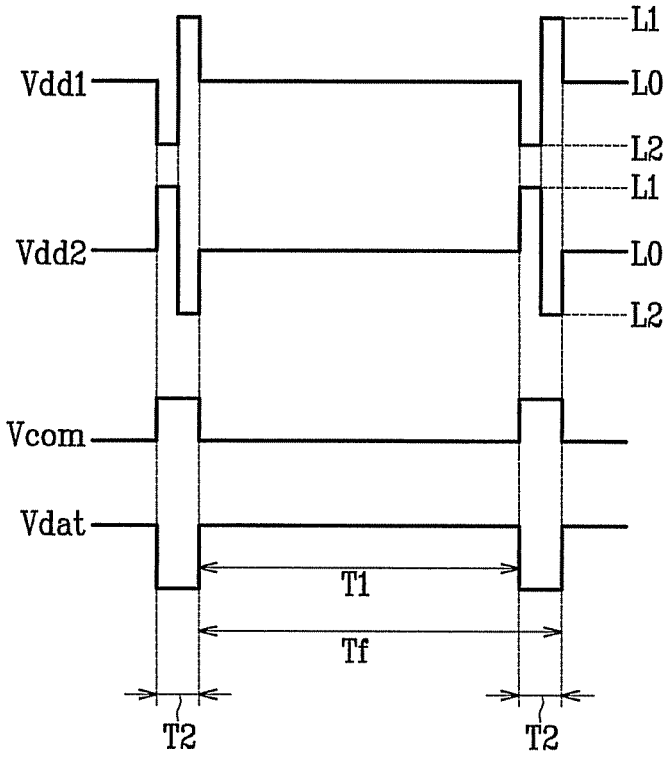
FIGS. 7, 8, and 9 show exemplary waveforms of various signals for an exemplary OLED display according to other exemplary embodiments of the present invention.

FIG. 3 shows waveforms of various signals in an exemplary OLED display according to an exemplary embodiment of the present invention, FIGS. 4, 5 and 6 schematically show currents in exemplary first and second driving transistors, and FIG. 7 shows waveforms of various signals in an exemplary OLED display according to another exemplary embodiment of the present invention.

The signal controller 600 is supplied from an external graphics controller (not shown) with input image signals R, G and B and input control signals controlling the display thereof, as shown in FIG. 1. The input image signals R, G and B contain luminance information of each pixel PX, and the luminance has a predetermined number of grays, for example 1024(=$2^{10}$), 256(=$2^8$), or 64(=$2^6$) grays. The input control signals include a vertical synchronization signal Vsync, a horizontal synchronization signal Hsync, a main clock MCLK, and a data enable signal DE.

After generating scanning control signals CONT1, data control signals CONT2, and a voltage control signal CONT3 and processing the image signals R, G and B suitable for the operation of the display panel 300 on the basis of the input control signals and the input image signals R, G and B, the signal controller 600 sends the scanning control signals CONT1 to the scanning driver 400, the voltage control signal CONT3 to the voltage generator 700, and the processed image signals DAT and the data control signals CONT2 to the data driver 500.

The scanning control signals CONT1 include a scanning start signal STV for instructing the scanning driver 400 to start scanning and at least one clock signal for controlling the output time of the high voltage Von. The scanning control signals CONT1 may further include a plurality of output enable signals for defining the duration of the high voltage Von.

The data control signals CONT2 include a horizontal synchronization start signal STH for informing the data driver 500 to start transmission of digital image signals for a row of pixels PX, a load signal LOAD for instructing the data driver 500 to apply the analog data voltages to the data lines $D_1$-$D_m$, and a data clock signal HCLK.

The voltage generator 700 generates the first and the second driving voltages Vdd1 and Vdd2 and the common voltage Vcom, which vary periodically as shown in FIG. 3, according to the voltage control signal CONT3. The voltage generator 700 applies the generated voltages Vdd1, Vdd2 and Vcom to the display panel 300.

Responsive to the data control signals CONT2 from the signal controller 600, the data driver 500 receives a packet of digital image signals DAT from the signal controller 600, converts the digital image signals DAT into analog data voltages Vdat, and applies the data voltages Vdat to the data lines $D_1$-$D_m$.

The scanning driver 400 makes scanning signals equal to the high voltage Von in response to the scanning control signals CONT1 from the signal controller 600.

Then, the first and second switching transistors Qs1 and Qs2 connected to the scanning signal lines $G_i$ are turned on to apply the data voltages from the output terminals of the first and second switching transistors Qs1 and Qs2 to the control terminals of the first and the second driving transistors Qd1 and Qd2 and the first and second capacitors Cst1 and Cst2. At this time, the first and second driving voltages Vdd1 and Vdd2 maintain reference levels L0 as shown in FIG. 3.

The first and second driving transistors Qd1 and Qd2 output currents corresponding to the data voltages Vdat. At this time, since the control terminals of the first driving transistor Qd1 and the second driving transistor Qd2 are supplied with the same data voltage Vdat and the first driving voltage Vdd1 and the second driving voltage Vdd2 have equal magnitudes, the direction of the current I1 in the first driving transistor Qd1 is the same as the direction of the current I2 in the second driving transistor Qd2 as shown in FIG. 4, and thus the output currents of the first driving transistor Qd1 and the second driving transistor Qd2 have the same direction and magnitude.

The output currents of the first and the second driving transistors Qd1 and Qd2 are joined to form a driving current $I_{LD}$ that flows into the OLED LD. The OLED LD emits light having an intensity corresponding to the driving current $I_{LD}$.

The above-described operation is performed from the first pixel row to the last pixel row of the display panel 300 to display an image, and this time period is herein referred to as a display period T1. The remaining time period is herein referred to as a refresh period T2, and reference character Tf shown in FIG. 3 denotes a time period of one frame, having substantially the same time as the display period T1 plus the refresh period T2.

As shown in FIG. 3, when the display period T1 is finished and the refresh period T2 begins, all the switching transistors Qs1 and Qs2 turn off, as indicated by the drop in the data voltage Vdat. However, since the capacitors Cst1 and Cst2 store and maintain the data voltages Vdat, the voltage differences between the control terminals and the input terminals of the driving transistors Qd1 and Qd2, which are connected to the capacitors Cst1 and Cst2, are uniformly maintained.

During the refresh period T2, the voltage generator 700 exchanges the voltage levels of the first driving voltage Vdd1 and the second driving voltage Vdd2 with respect to the reference level L0 such that the direction of the voltage bias between the input terminal and the output terminal of the first driving transistor Qd1 is opposite the direction of the voltage bias between the input terminal and the output terminal of the second driving transistor Qd2.

When the first and the second driving transistors Qd1 and Qd2 maintain their turn-on states, as shown in FIGS. 5 and 6, the current I1 flowing in the first driving transistor Qd1 points opposite the current I2 in the second driving transistor Qd2. In FIG. 5, the current I2 in the second driving transistor Qd2 points to the OLED LD, and the current I1 in the first driving transistor Qd1 points to the first driving voltage Vdd1 opposite the current I2. On the contrary, in FIG. 6, the current I1 in the first driving transistor Qd1 flows toward the OLED LD, while the current I2 in the second driving transistor Qd2 flows toward the second driving voltage Vdd2.

The first and second driving transistors Qd1 and Qd2 may turn off, and in this case, the voltage biases between the input terminals and the output terminals of the first and second driving transistors Qd1 and Qd2 are substantially the same as those shown in FIGS. 5 and 6. That is, the voltage lowers along the direction of the arrows shown in FIGS. 5 and 6. Hereinafter, the terms "current flow" and "current direction" will be also used for denoting the voltage bias flow and the voltage bias direction, respectively, if there is no particular definition.

For making the current flow shown in FIG. 5, the second driving voltage Vdd2 becomes a first level L1 higher than the reference level L0, and the first driving voltage Vdd1 becomes a second level L2 lower than the reference level L0, as indicated in the first refresh period T2 shown in FIG. 3. On the contrary, for making the current flow or the voltage bias shown in FIG. 6, the first driving voltage Vdd1 becomes the first level L1 higher than the reference level L0 and the second driving voltage Vdd2 becomes the second level L2 lower than the reference level L0, as indicated in the second refresh period T2 shown in FIG. 3.

At this time, the first level L1 and the second level L2 are determined so as to obtain the current flow shown in FIGS. 5 and 6. The first and second levels L1 and L2 of the first driving voltage Vdd1 may be different from the first and second levels L1 and L2 of the second driving voltage Vdd2.

Each of the currents I1 and I2 in the first and second driving transistors Qd1 and Qd2 points opposite directions in two adjacent refresh periods T2. That is, the current flows shown in FIGS. 5 and 6 alternately appear. In other words, in a first refresh period T2, current flowing through the first driving transistor Qd1 points towards the OLED LD while current flowing through the second transistor Qd2 points away from the OLED LD. After a first display period T1 and in a second refresh period T2, current flowing through the first driving transistor Qd1 points away from the OLED LD while current flowing through the second transistor Qd2 points towards the OLED LD. After a second display period T1 and in a third refresh period T2, current flowing through the first driving transistor Qd1 points towards the OLED LD while current flowing through the second transistor Qd2 points away from the OLED LD, and so on.

However, in an alternative embodiment, the current flows shown in FIGS. 5 and 6 may appear in a single refresh period T2. In this case, the first driving voltage Vdd1 and the second driving voltage Vdd2 may swing between the first level L1 and the second level L2 within a single refresh period T2 as shown in FIG. 7, and may occur in each subsequent refresh period T2 following each display period T1. As shown in FIG. 7, each refresh period T2 may be split substantially evenly between a time period for the current flow shown in FIG. 5 and a time period for the current flow shown in FIG. 6.

In either embodiment, the current directions flowing in the driving transistors Qd1 and Qd2 periodically vary, thereby reducing the degradation of the driving transistors Qd1 and Qd2.

In the meantime, the driving voltages Vdd1 and Vdd2 vary during the refresh period T2 and thus the output currents from the output terminals of the driving transistors Qd1 and Qd2 may not be uniform. In particular, the driving transistors Qd1 and Qd2 for displaying a dark image are required to output no current, but the variation of the driving voltages Vdd1 and Vdd2 during the refresh period T2 may generate the driving current $I_{LD}$ flowing into the OLED LD to make the OLED LD emit light.

In order to prevent such light emission of the OLED LD during a display of a dark image, the voltage generator 700 raises the voltage levels of the common voltage Vcom during the refresh period T2 as shown in FIG. 3 to ensure no current flowing in the OLED LD.

The raised voltage level of the common voltage Vcom during the refresh period T2 makes the OLED LD stop light emission and all the pixels PX become dark states, which is equivalent to impulsive driving.

The control terminals of the first and second driving transistors Qd1 and Qd2 are supplied with a data voltage Vdat during the display period T1, but are floating during the refresh period T2. In other words, the control terminals of the first and second driving transistors Qd1 and Qd2 are not supplied with the data voltage Vdat during the refresh period T2, as shown in FIGS. 3 and 7.

Next, an operation of an exemplary OLED display according to another exemplary embodiment of the present invention will be described with reference to FIG. 8.

Figure 8:
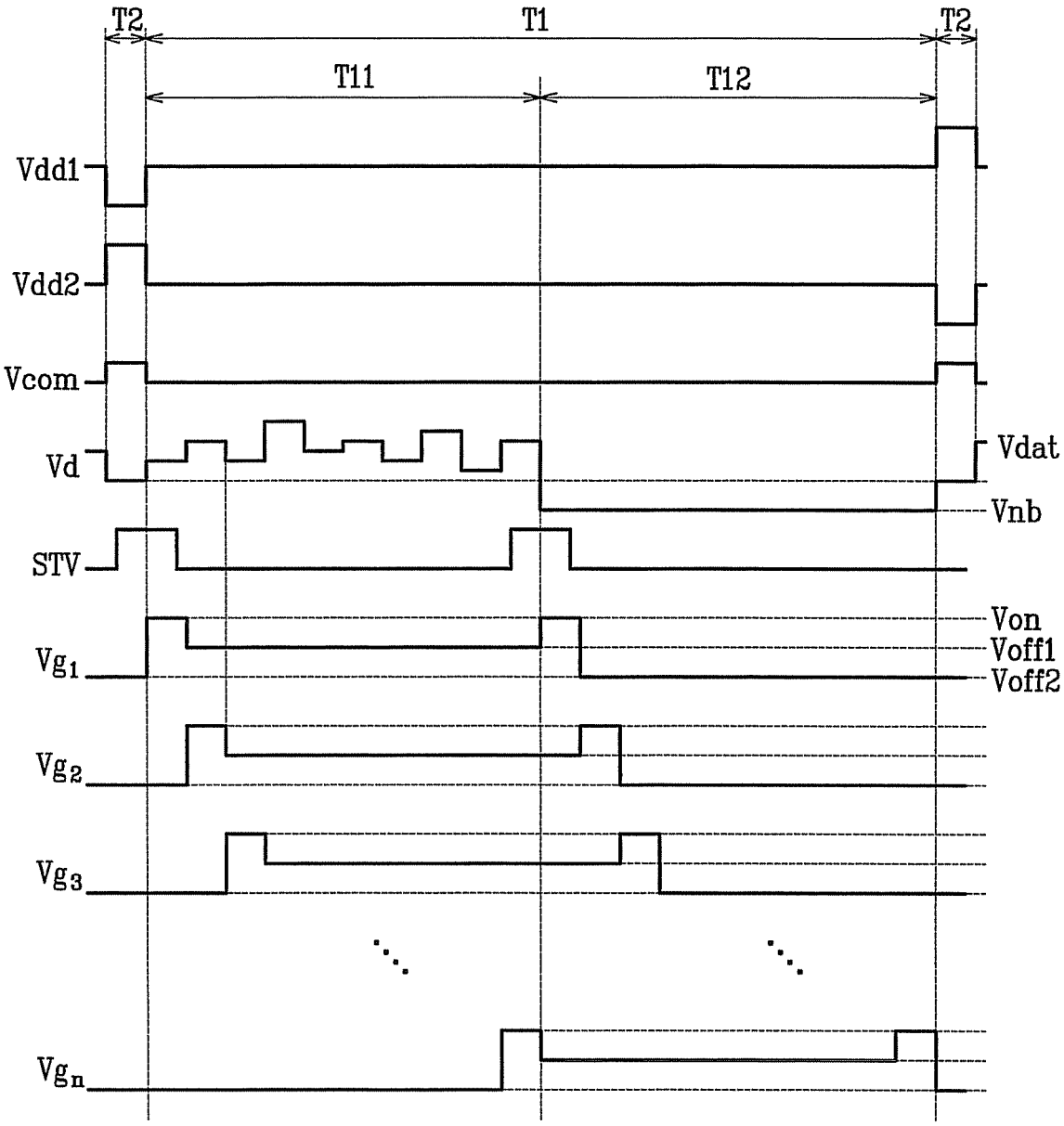

FIG. 8 shows waveforms of various signals in an exemplary OLED display according to another exemplary embodiment of the present invention.

Referring to FIG. 8, a display period T1 is divided into a first time period T11 for applying data voltages Vdat for the pixels PX and a second time period T12 for applying a reverse bias voltage Vnb for the pixels PX. The reverse bias voltage Vnb is applied through the data lines $D_1$-$D_m$ like the data voltages Vdat, and has a magnitude to turn off the driving transistors Qd1 and Qd2. Reference character Vd shown in FIG. 8 denotes voltages outputted from the data driver 500 or applied to the data lines $D_1$-$D_m$. Thus the voltages Vd vary from the data voltages Vdat applied during the first time period T11 to the reverse bias voltage Vnb applied during the second time period T12.

In FIG. 8, reference character $Vg_i$ (i=1, 2, . . . , n) denotes a gate signal applied to the i-th gate line $G_i$. The gate signal $Vg_i$ can have three voltage levels, a high voltage Von for turning on the switching elements Qs1 and Qs2 and two low voltages Voff1 and Voff2 for turning off the switching elements Qs1 and Qs2. The higher low voltage Voff1 of the two low voltages Voff1 and Voff2 is used during the first time period T11 for turning off the switching transistors Qs1 and Qs2 during the first time period T11. The lower low voltage Voff2 of the low voltages Voff1 and Voff2 is used during the second time period T12 for applying the reverse bias voltage Vnb to the data lines $D_1$-$D_m$ for reducing current leakage that may be generated due to low gate-to-source voltage of the switching transistors Qs1 and Qs2 resulting from the low reverse bias voltage Vnb.

In this way, the reverse bias voltage Vnb is applied to the driving transistors Qd1 and Qd2 within the second time period T12 of the display period T1 such that the driving transistors Qd1 and Qd2 can rest during the second time period T12 without outputting currents, thereby reducing the stress caused by the long-time generation of the currents.

Next, an operation of an exemplary OLED display according to another exemplary embodiment of the present invention will be described with reference to FIG. 9.

Figure 9:
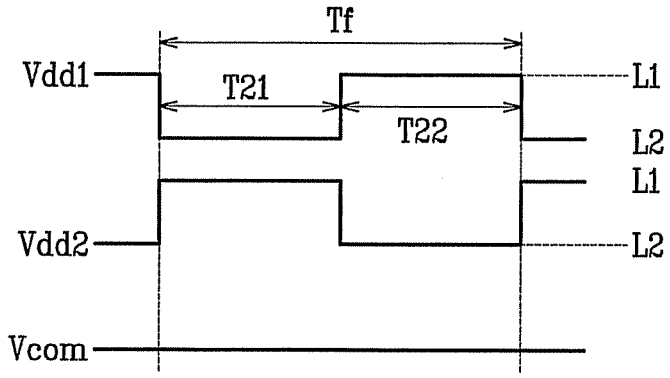

FIG. 9 shows waveforms of various signals in an exemplary OLED display according to another exemplary embodiment of the present invention.

Referring to FIG. 9, the OLED display divides one frame period Tf into two time periods T21 and T22, where the driving voltages Vdd1 and Vdd2 have opposite magnitudes, without providing a separate refresh period. The data voltages Vdat for the pixels PX are successively applied and the application of the data voltages is not stopped such that the OLED LD continues to emit light. At this time, the magnitudes of the driving voltages Vdd1 and Vdd2 and the magnitudes of the data voltages are preferably determined so that each OLED LD can emit light having an intensity corresponding to the luminance information contained in the input image signals R, G and B.

Next, OLED displays according to other exemplary embodiments of the present invention will be described with reference to FIGS. 10 and 11 as well as FIG. 1.

Figure 10:
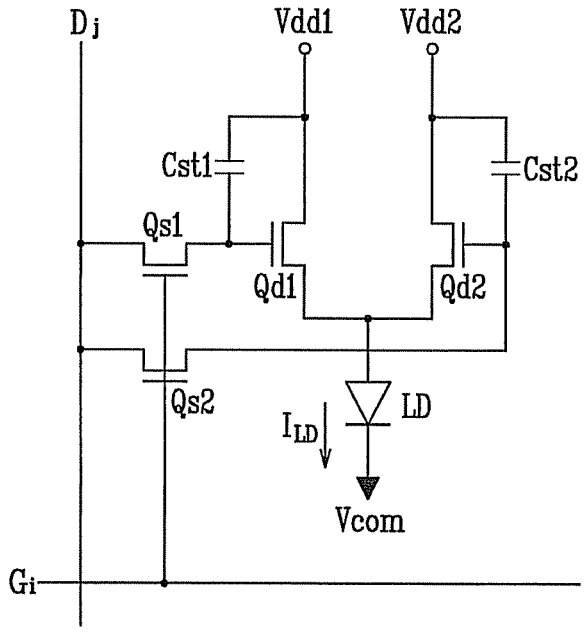
FIGS. 10 and 11 are equivalent circuit diagrams of exemplary pixels of exemplary OLED displays according to other exemplary embodiments of the present invention.
Figure 11:
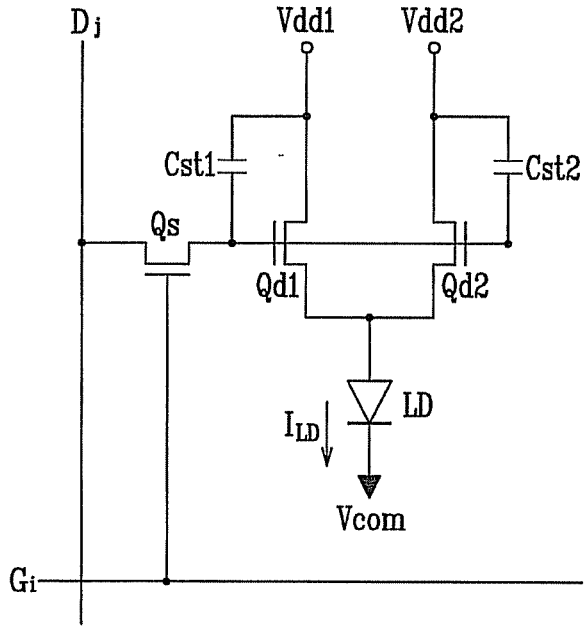

FIGS. 10 and 11 are equivalent circuit diagrams of exemplary pixels of exemplary OLED displays according to other exemplary embodiments of the present invention.

Each of the OLED displays shown in FIGS. 10 and 11 includes signal lines $G_i$ and $D_j$ and a pixel PX as does the OLED display shown in FIG. 2. However, the data line $D_j$ is not bifurcated in FIGS. 10 and 11 as in FIG. 2.

Each pixel PX of the OLED display shown in FIG. 10, like the pixel PX shown in FIG. 2, includes an OLED LD, first and second driving transistors Qd1 and Qd2, first and second capacitors Cst1 and Cst2, and first and second switching transistors Qs1 and Qs2.

However, unlike FIG. 2, the first switching transistor Qs1 and the second switching transistor Qs2 of the OLED display shown in FIG. 10 are connected to a single data line $D_j$.

Each pixel PX of the OLED display shown in FIG. 11, like the pixel PX shown in FIG. 2, includes an OLED LD, first and second driving transistors Qd1 and Qd2, and first and second capacitors Cst1 and Cst2. However, the pixel PX shown in FIG. 11 includes only one switching transistor Qs unlike FIGS. 2 and 10. Therefore, first and second driving transistors Qd1 and Qd2 and first and second capacitors Cst1 and Cst2 are connected to the single switching transistor Qs.

The operation of the OLED displays shown in FIGS. 10 and 11 is substantially the same as that shown in FIG. 2, and thus the detailed description thereof will be omitted.

As described above, the exemplary embodiments of the present invention reverse the direction of the currents flowing in the driving transistors or the direction of the voltage bias between the input terminals and the output terminals of the driving transistors, thereby reducing the degradation of the driving transistors.

In addition, negative bias voltage may be applied to the control terminals of the driving transistors to make the driving transistors rest, thereby further reducing the degradation of the driving transistors.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A display device comprising:

a light emitting element;

a first driving transistor coupled to the light emitting element and supplied with a first driving voltage; and a second driving transistor coupled to the light emitting element and the first driving transistor and supplied with a second driving voltage having a magnitude different from the first driving voltage at least for a time, wherein a direction of a current flowing in the first driving transistor is opposite to a direction of a current flowing in the second driving transistor for the time, and wherein the light emitting element stops light emission for the time.

2. The display device of claim 1, wherein the first driving voltage and the second driving voltage are periodical signals having time-varying magnitudes.

3. The display device of claim 2, wherein the first driving voltage and the second driving voltage have a reference value during a first time period and have different values during a second time period.

4. The display device of claim 3, wherein the first driving voltage has a first value during the second time period different from the reference value and different from a second value of the second driving voltage during the second time period.

5. The display device of claim 3, wherein the first driving voltage and the second driving voltage have opposite values with respect to the reference value during the second time period.

6. The display device of claim 5, wherein the first time period and the second time period alternate, the first driving voltage maintains a uniform value during the second time period, and the second driving voltage maintains a uniform value during the second time period.

7. The display device of claim 5, wherein the first time period and the second time period alternate, and a value of each of the first driving voltage and the second driving voltage varies in an opposite manner with respect to the reference value during the second time period.

8. The display device of claim 7, wherein the first driving voltage includes a lower value and a higher value than the reference value during the second time period, and the second driving voltage includes a higher value and a lower value than the reference value during the second time period.

9. The display device of claim 3, wherein the light emitting element stops light emission during the second time period.

10. The display device of claim 9, wherein the light emitting element is supplied with a common voltage, and the common voltage has different values between the first time period and the second time period.

11. The display device of claim 10, wherein the common voltage is increased during the second time period.

12. The display device of claim 3, wherein the first time period includes a third time period and a fourth time period, and the light emitting element emits light in the third time period and stops light emission in the fourth time period.

13. The display device of claim 12, wherein the first and second driving transistors are supplied with a reverse bias voltage during the fourth time period to turn off the first and second driving transistors during the fourth time period.

14. The display device of claim 3, wherein the first driving transistor has a control terminal, an input terminal supplied with the first driving voltage, and an output terminal coupled to the light emitting element, wherein the second driving transistor has a control terminal, an input terminal supplied with the second driving voltage, and an output terminal coupled to the light emitting element, and wherein the control terminals of the first and the second driving transistors are supplied with a data voltage during the first time period and are floating during the second time period.

15. The display device of claim 14, wherein the first and second driving transistors are supplied with a reverse bias voltage to turn off the first and second driving transistors for a portion of the first time period.

16. The display device of claim 3, further comprising:

a first switching transistor coupled to the first driving transistor and applying a data voltage to a control terminal of the first driving transistor according to a scanning signal; and a second switching transistor coupled to the second driving transistor and applying a data voltage to a control terminal of the second driving transistor according to the scanning signal.

17. The display device of claim 16, wherein a control terminal of the first switching transistor and a control terminal of the second switching transistor are connected to a same scanning line.

18. The display device of claim 3, further comprising a switching transistor coupled to the first and the second driving transistors and applying a data voltage to control terminals of the first and the second driving transistors according to a scanning signal.

19. The display device of claim 3, further comprising:

a first capacitor connected between a control terminal and an input terminal of the first driving transistor; and a second capacitor connected between a control terminal and an input terminal of the second driving transistor.

20. The display device of claim 1, further comprising a plurality of first driving transistors, a plurality of second driving transistors, and a plurality of pixels, wherein each pixel includes one of the first driving transistors and one of the second driving transistors.

21. The display device of claim 1, further comprising a voltage generator supplying the first driving voltage, the second driving voltage, and a common voltage to the first driving transistor, the second driving transistor, and the light emitting element, respectively.

22. A display device comprising:

a light emitting element; and at least one driving transistor supplying a current to the light emitting element, wherein a direction of a current flowing in the at least one driving transistor changes at least for a time to flow in an opposite direction of a current flowing in another driving transistor supplying a current to the light emitting element for the time, and wherein the light emitting element stops light emission for the time.

23. The display device of claim 22, wherein the direction of the current flowing in the at least one driving transistor is opposite between a first time period and a second time period shorter than the first time period, and the light emitting element stops light emission in the second time period.

24. A display device comprising:

a light emitting element;

a first driving transistor supplying a current to the light emitting element; and a second driving transistor supplying a current to the light emitting element, wherein a direction of a current flowing in the first driving transistor is opposite to a direction of a current flowing in the second driving transistor at least for a time, wherein the light emitting element stops light emission for the time.

25. The display device of claim 24, wherein the current flowing in the first driving transistor points in a same direction as the current flowing in the second driving transistor during a light emission display period of the light emitting element, and the current flowing in the first driving transistor flows opposite to the current flowing in the second driving transistor during a refresh period preventing degradation of the first and second driving transistors.

26. A method of driving a display device, the method comprising:

applying a data voltage to control terminals of the first and the second driving transistors having output terminals coupled to a light emitting element;

applying a first driving voltage to an input terminal of the first driving transistor;

applying a second driving voltage to an input terminal of the second driving transistor the second driving voltage; and differentiating values of the first driving voltage and the second driving voltage at least for a time, wherein a direction of a current flowing in the first driving transistor is opposite to a direction of a current flowing in the second driving transistor for the time, wherein the light emitting element stops light emission for the time.

27. The method of claim 26, wherein differentiating values of the first driving voltage and the second driving voltage includes providing opposite values with respect to a reference value during a refresh period to prevent degradation of the first and second driving transistors.

28. The method of claim 26, further comprising:

equalizing values of the first driving voltage and the second driving voltage, wherein differentiating values of the first driving voltage and the second driving voltage and equalizing values of the first driving voltage and the second driving voltage are alternately performed.

29. The method of claim 28, wherein equalizing the first driving voltage and the second driving voltage comprises:

emitting the light emitting element, and wherein differentiating the first driving voltage and the second driving voltage comprises:

stopping emission of the light emitting element.

30. The method of claim 29, wherein stopping emission of the light emitting element comprises:

changing a value of a common voltage applied to the light emitting element.

31. The method of claim 28, wherein the equalizing the first driving voltage and the second driving voltage comprises:

emitting the light emitting element; and stopping emission of the light emitting element.

32. The method of claim 31, wherein stopping emission of the light emitting element comprises:

applying a negative bias voltage to the control terminals of the first and the second driving transistors.

* * * * *